US005593243A

United States Patent [19]

Mori

[11] Patent Number: 5,593,243

[45] Date of Patent: Jan. 14, 1997

[54] BINDER

[75] Inventor: Chuzo Mori, Tokyo, Japan

[73] Assignee: Carl Manufacturing Co., Ltd., Tokyo, Japan

[21] Appl. No.: 439,890

[22] Filed: May 12, 1995

[30] Foreign Application Priority Data

May 20, 1994 [JP] Japan ..... 6-131024
Jul. 12, 1994 [JP] Japan ..... 6-182960

[51] Int. Cl.[6] ..... B42F 3/02

[52] U.S. Cl. ..... 402/52; 402/46

[58] Field of Search ..... 402/46, 47, 48, 402/52, 54

[56] References Cited

U.S. PATENT DOCUMENTS

| | | | |
|---|---|---|---|
| 581,123 | 4/1897 | Leslie | 402/52 |
| 681,223 | 8/1901 | Hulquist | 402/52 |
| 793,735 | 7/1905 | McDonald | 402/52 X |
| 1,784,315 | 12/1930 | Power | 402/52 |
| 1,995,735 | 3/1935 | Dawson et al. | 402/46 |
| 1,996,940 | 4/1935 | Unger | 402/46 |
| 4,129,396 | 12/1978 | Stecklow | 402/46 |
| 4,730,950 | 3/1988 | Ominato | 402/46 R |

*Primary Examiner*—Willmon Fridie, Jr.
*Attorney, Agent, or Firm*—Oliff & Berridge

[57] ABSTRACT

A binder to bind papers between a paper supporting plate and a paper holding plate by inserting paper binding cylinders into punched holes of said papers, which comprises a rear plate formed in L-letter in section at an edge of said paper supporting plate, a rack forming plate formed in L-letter in section at an edge of said paper holding plate, opposing said rear plate and overlapping each other, guide portions provided on inner side of the rear plate in the areas of both side edges for guiding both side edges of the rack forming plate and allowing a vertical and parallel movement against the rear plate, rack teeth having configuration of saw teeth in section provided on the surface of said rack forming plate opposing to the inner side of the rear plate, click member rotatably mounted on the rear plate, having a click pawl for engaging with said rack teeth to prevent the rack forming plate from moving upward, and a spring means provided on said click member to bias said click pawl resiliently against the rack teeth, wherein papers can be bound regardless the thickness thereof merely by depressing the paper holding plate.

5 Claims, 20 Drawing Sheets

BINDER

BACKGROUND OF THE INVENTION

1. Field of the Invention

The present invention relates to a binder which can bind many sheets of paper to be bound even if those are increased in number.

2. Prior Art

A typical conventional binder will be explained by referring to FIG. 32. In this binder, supporting portion 1 is connected to a rear plate 3 through a hinge 2 and by bending an end of the rear plate 3 at a right angle a stopper mounting portion 4 is provided. On this stopper mounting portion 4 a stopper 5 is mounted rotatably in direction of an arrow through a hinge against biasing force of a spring 6. When binding papers, after inclining the rear plate 3 in a position indicated in phantom line, into punched holes of the papers paper-binding-cylinders 8 provided on the supporting portion 1 are inserted, then while raising said rear plate 3' to the position of 3, a member 9 is located behind the stopper 5 and those are unified by engaging projections 11 provided on the surface of the member 9 with stopping holes 12 formed on the stopper 5.

A well known clamp device in a binder is formed in such a manner as a pair of end bases of a clamp are supported rotatably on the inside of a flange of a supporting frame having U-letter shape in section, gears are formed on said pair of end bases and a worm gear engaging with said gears is supported on a rib portion of said frame as being pivoted thereon, by rotation of which both tip ends of said pair of clamps come close or get away with each other, thereby an opening extent of said tip ends can be adjusted arbitrarily to settle the clamping force of said tip ends of the clamp.

In those conventional examples as mentioned above, each has issues to be improved as follows. First, in the example illustrated in FIG. 32, the number of sheets of paper to be bound is limited by the height H of the rear plate 3. That causes such problem as necessary papers to be bound as one document in one binder have to be bound separately in another binder because of the thickness of the papers thicker than the size of the height H. Further, since the height H of the rear plate 3 is prepared in advance sufficiently high in order to bind many sheets of paper, even if a small sheets of paper are bound, such binder needs a sufficient space therefor in a shelf, which causes the binder to be improved in the light of accommodation space in a shelf.

Next, a conventional clamp device has the following problems. That is, although it is advantageous to bind comparatively small sheets of paper, because the opening degree of the clamp and a clamping force are acquired appropriately, when a number of sheets is increased to such extent as distal ends of the clamp members are spread wider than the basement space of the clamp members due to the volume of papers, some papers located at intermediate portion between the clamp members are apt to be disassembled therefrom, which is troublesome to re-collect such separated papers in order.

On the other hand, in order to prevent such papers from being disassembled, it is necessary to make the height of a supporting frame sufficient and to use the clamp in such a manner as the basement space of the clamp is kept wider than the space between the distal ends of the clamp members even if many sheets of paper are clamped. For that purpose, like in the afore-mentioned conventional example, even if a number of sheets to be bound is small, a space to be taken by such binder is the one in which the predetermined thickness of the binder can be accommodated, which raises a problem to be solved in the light of binder accommodation space in a shelf.

Next, as a third conventional binder, here is such type of binder as using a pair of boards i.e. a front cover and a rear cover, in which these two boards are drawn by drawing springs. Papers are clamped between these covers under the drawing force of such springs, so that, stronger the force of spring, stronger the force of opening these covers for adding some additional papers against the spring force is needed, which rises a problem to be solved in the light of easiness to use such binder. The present invention is to provide a binder which can regulate the thickness of a binding device in accordance with a volume of papers to be bound i.e. in case a volume is small, the thickness becomes small where accommodation space in a shelf is advantageous, and in case the volume is large, the thickness becomes large in accordance with the volume of papers.

SUMMARY OF THE INVENTION

In order to solve the afore-mentioned problems, the present invention provides a binder, which binds papers by inserting pins into the punched holes of papers to be bound, comprising a base frame formed in a configuration of L-letter shape with a rear plate and a paper supporting plate, a rack forming plate which forms a L-letter shape with a paper holding plate and moves vertically along with the inside of said rear plate, wherein said rack is formed like saw teeth in section and a click member having a click pawl to engage with said saw teeth of the rack is pivotally and rotatably mounted on the rear plate. Further, according to the present invention, both side ends of said rack forming plate are guided in guide portions provided on both sides of the rear plate.

Still further, according to the present invention, approximately at central portion of both the rear plate and the rack forming plate viewing horizontally, there are a pair of guide angles running in parallel in vertical direction, thereby the rack forming plate can slide up and down to the rear plate.

Still further, according to the present invention, on the click member mounted pivotally on the rear plate spring means are provided for biasing resiliently said click pawl against the rack and by engaging with the saw teeth of the rack plate the rack forming plate is prevented from moving upward.

Still further according to the present invention, spring means are installed on the click member mounted rotatably on the rear plate of the base frame for biasing the click member against the rack, thereby the click pawl is biased resiliently against the rack teeth of the rack forming plate and prevent the rack forming plate and the paper holding plate from moving upward along the rear plate by engagement of the pawl with the appropriate rack teeth. The engagement of the click pawl of the click member with the rack teeth does not occur when the paper holding plate i.e. the rack forming plate is depressed, to the contrary when it is raised the engagement occurs.

Still further, according to the present invention, under the click member and on the rear plate, there is provided with a slider, which slides horizontally on a guide surface, and said slider is provided with a slope as a cam, on the surface of which the click member contacts so as to release the click pawl from engagement with the rack teeth.

Still further, according to the present invention, a pin is inserted into a paper binding cylinder through a contraction spring in such a manner as said pin is popped up from said cylinder and the cylinder is fixed on either the paper supporting plate or the paper holding plate.

Since the present invention is thus constituted, it plays the following functions.

In a type of binder which binds papers by inserting pins into the punched holes, the base frame is formed by the combination of paper supporting plate and rear plate in a configuration of L-letter in section, while the paper holding plate is combined with a rack forming plate to be formed in a configuration of L-letter shape in section and to get in touch with the inside of the rear plate, thereby due to the rigidity derived from unification of the paper supporting plate and the rear plate in a L-letter shape as well as the unification of the paper holding plate and the rack forming plate in a L-letter shape, the paper clamping force at the area of comparatively close to the distal ends of the paper supporting plate and the paper holding plate is kept, and in addition due to the connection of the rack forming plate to the rear plate, such rigidity may be further strengthened.

Thus, since the paper supporting plate and the paper holding plate are provided with rigidity and papers are clamped at comparatively close to the distal ends of those plates, it becomes possible to ensure a space to provide the click member between the rear plate and the rack forming plate.

Further, due to the rigidity thus secured, it is possible to keep the thickness of papers to be bound as thin as possible by compacting these papers by the paper holding plate to the paper supporting plate. And due to the relative positioning between the rear plate and the rack forming plate, the spacing between the paper supporting plate and the paper holding plate can be regulated, by which the binder can bind papers in accordance with the volume thereof.

And, by the provision of rack teeth on the rack forming plate of the paper holding member and a rotatable click member on the rear plate having click pawl to engage with said rack teeth, an engagement occurs merely when said rack forming plate is moved up, and the paper holding plate can descend without engaging with the click pawl which can be rotated resiliently by being pushed by the back of the rack teeth, so that the paper holding plate descended to compact the papers to be bound and there, it is prevented from moving upward by the engagement of the click pawl with the rack teeth. Thereby, it is possible to bind a given volume of paper in the minimum thickness by preventing the movement in a direction of spreading the spacing between the paper supporting plate and the paper holding plate.

Further, according to the present invention, since both side edges of the rack forming plate are slidably guided in guide portions provided on both sides of the rear plate of the base frame, the rear plate and the rack forming plate are prevented from departing in opposite direction each other allowing the rack forming plate to move vertically along the rear plate.

Thus, since the rear plate and the rack forming plate are prevented from moving in an opposite direction, the rigidity between the base frame formed in L-letter shape in section and the paper holding member formed in L-letter shape in section can be further secured.

Further, according to the present invention, since the click member is mounted rotatably on the rear plate, by a spring provided on the click member to give a force to said member for biasing it continuously against the rack teeth of the rack forming plate, the engagement between the click pawl and the teeth of the rack will occur automatically when the paper holding plate is depressed along the rear plate. Thereby, it becomes possible to bind a given amount of papers piled up by compacting while depressing it.

Further, according to the present invention, the click member is provided with a slider guide surface on the lowermost end thereof, which gets in contact with a cam surface of a slider slidably mounted on the rear plate. Thereby, when the slider is slid, the cam surface of the slider can make the click member to rotate against the spring for disengaging the click pawl from the rack teeth. Accordingly, for instance, a knob of the slider is projected from the rear plate can allow a user to disengage the click pawl, remove the paper holding plate from the basement frame and bind additional papers. Further, according to the present invention, a movable pin is inserted in a paper binding cylinder loaded with a contraction spring and projects from the cylinder and since such cylinder is fixed on the paper supporting plate, the movable pin is projected from cylinder at the most elongated position when the paper holding plate is removed from the base frame, it becomes possible to bind papers in the most small thickness while compacting papers and depressing the movable pin by the paper holding plate. Further, by the movement of the rack forming plate along the rear plate, it becomes possible to regulate the spacing between the paper supporting plate and the paper holding plate, thereby it becomes possible to bind papers in accordance with the amount of papers to be bound.

BRIEF DESCRIPTION OF THE DRAWINGS

FIG. 10A shows paper binding cylinder in dual structure as third embodiment into which a movable pin fixed on the paper holding plate is inserted

DETAILED EXPLANATION OF PREFERRED EMBODIMENT

Figure 5:
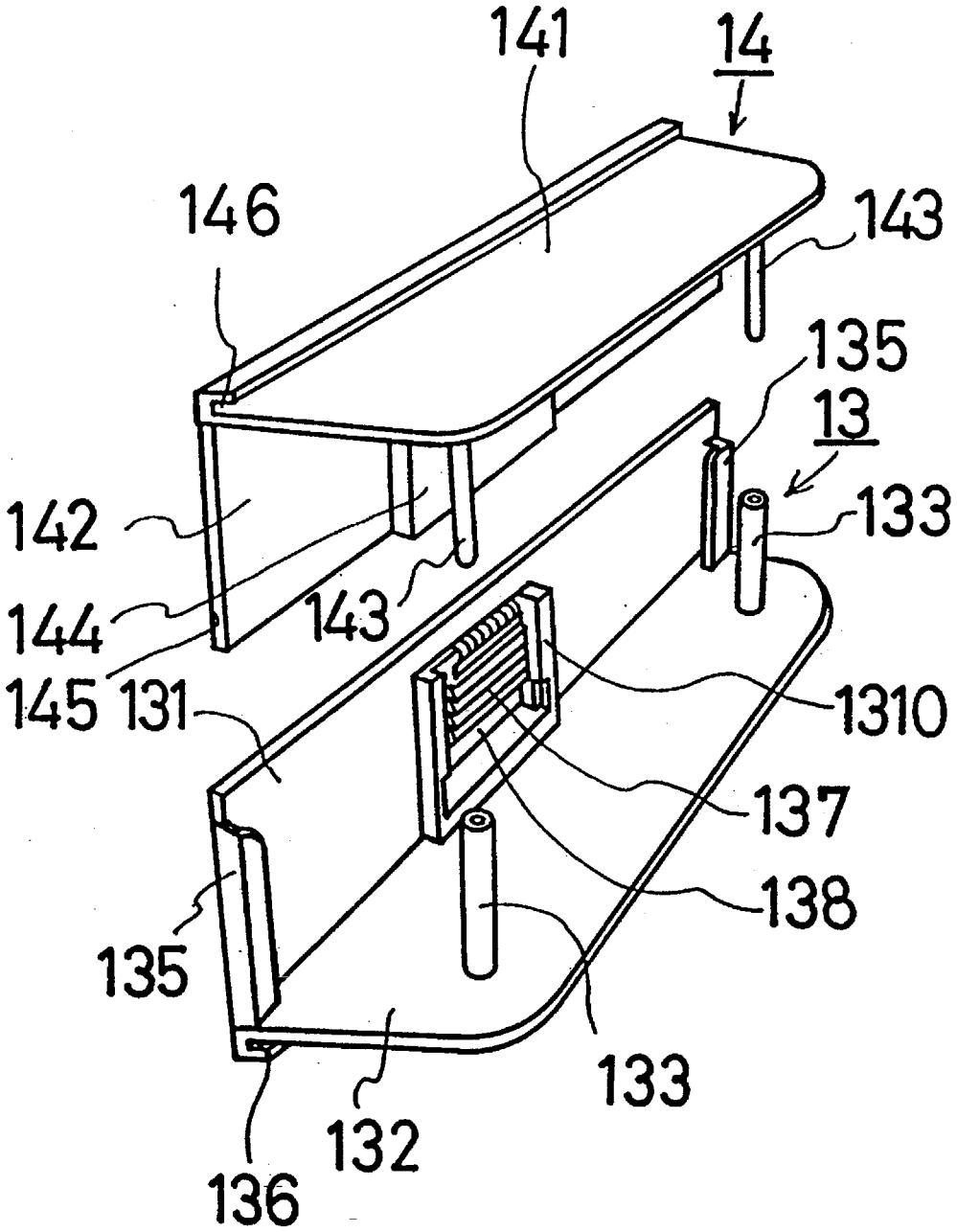
FIG. 5 shows a broken perspective view of the embodiment of illustrated in FIG. 1

Hereinafter embodiments of the present invention are explained. Referring to FIG. 5 illustrating an outline of the present invention, a base frame 13 is formed in a L-letter shape in section by connecting a rear plate 131 and a paper supporting plate 132 and on the paper supporting plate 132 paper binding cylinders 133 are planted and a click member 134 is mounted rotatably on the rear plate 131. Further, on both side end area of the rear plate 131 guide portions 135 are provided. And, at the connection corner of the rear plate 131 and the paper supporting plate 132 and on the back of the latter, a headcover fitting groove 136 is provided.

On the other hand, a paper holding member 14 is formed in a L-letter shape in section by combining a paper holding plate 141 and a rack forming plate 142, and on the back of the paper holding plate 141 paper binding pins are planted to be inserted into the paper binding cylinders 133. 144 designates portions of the rack forming plate 142 where rack teeth are to be provided. Both side edges 145 of the rack forming plate 142 are inserted in the guide portions 135, thereby the inner surface of the rear plate 131 and the outer surface of the rack forming plate 142 are located close with each other and the paper holding plate can move upward and downward against the base frame 13. And on the end of the paper holding plate 141 a headcover fitting groove is provided.

Figure 1:
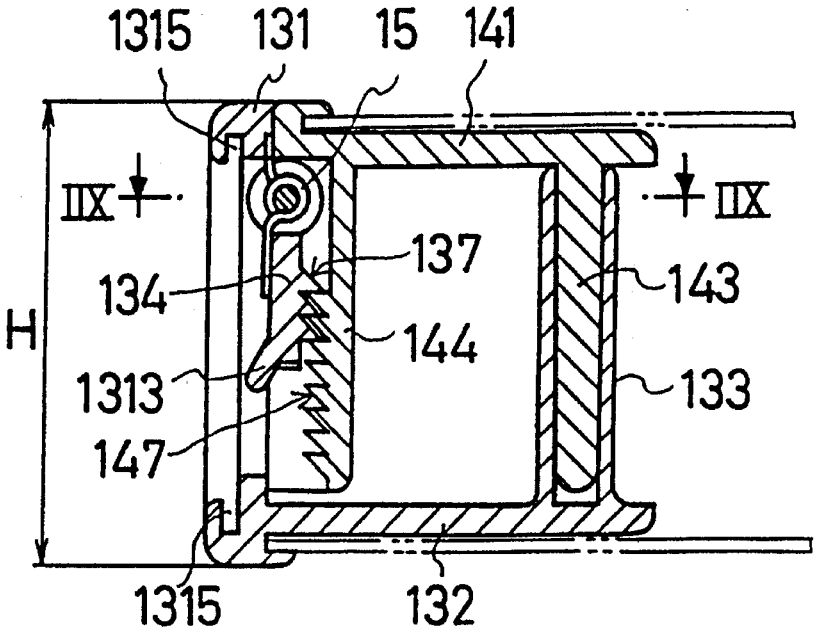
FIG. 1 shows a vertical sectional view along B—B line in FIG. 6 illustrating the first embodiment of the present invention
Figure 8:
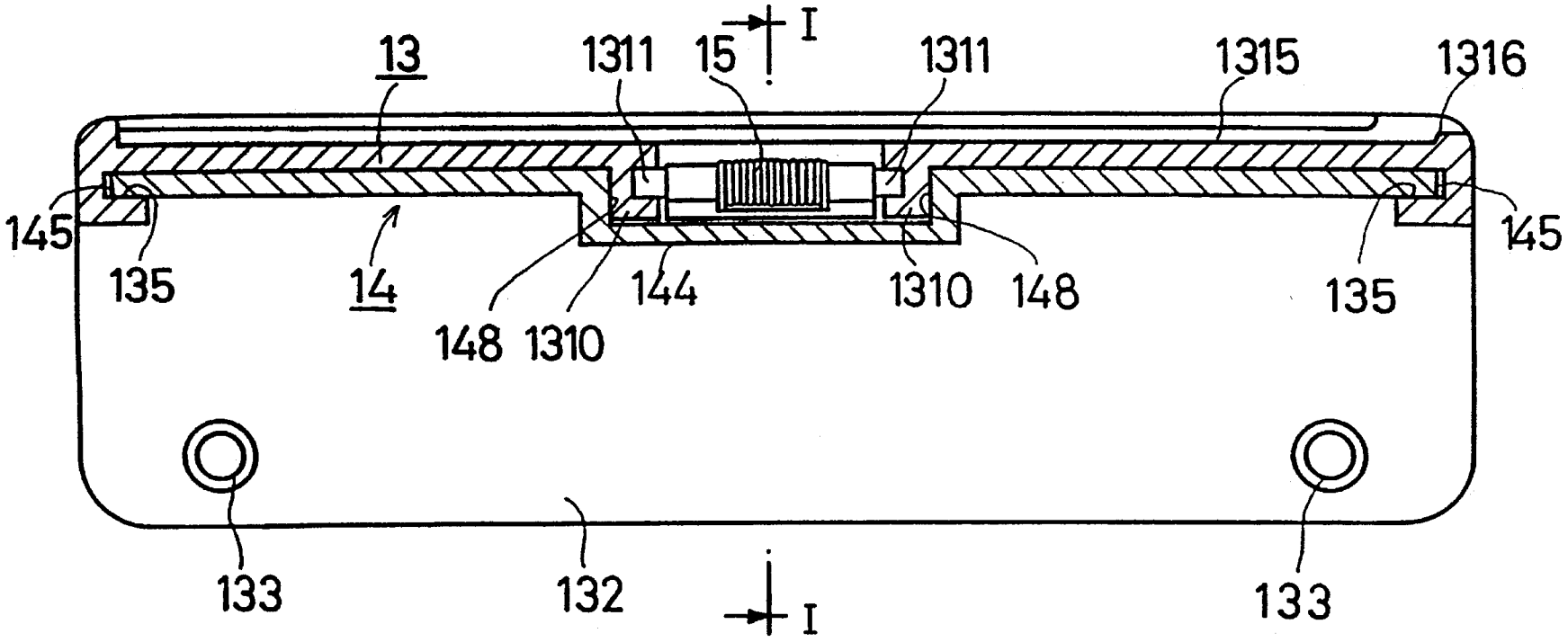
FIG. 8 shows a sectional view along A—A line of FIG. 1 wherein a rack forming plate is located along the rear plate

More details are explained hereinafter in order. FIG. 1 is a vertically sectional view along C—C line of FIG. 8 showing a click member 134 in section, wherein the sides 145 of the paper holding plate 141 are inserted and guided in the guide portions 135 of the base frame 13 shown in FIG. 5 to assemble the former to the latter. During such assembly, paper holding pins are inserted into paper binding cylinder 133 and the rack teeth 147 of the rack forming plate 142 and the click pawl 137 of the click member 134 are engaged. Such engagement prevents the paper holding plate 141 from moving upward along the base frame 13. Further, the click member 134 is resiliently biased by a spring 15 in such a direction as the click pawl continues to be pushed against the rack teeth 147. This spring 15 is installed in a spring receiver 151 (see FIGS. 6 and and 28) provided on the click member 134.

Figure 3:
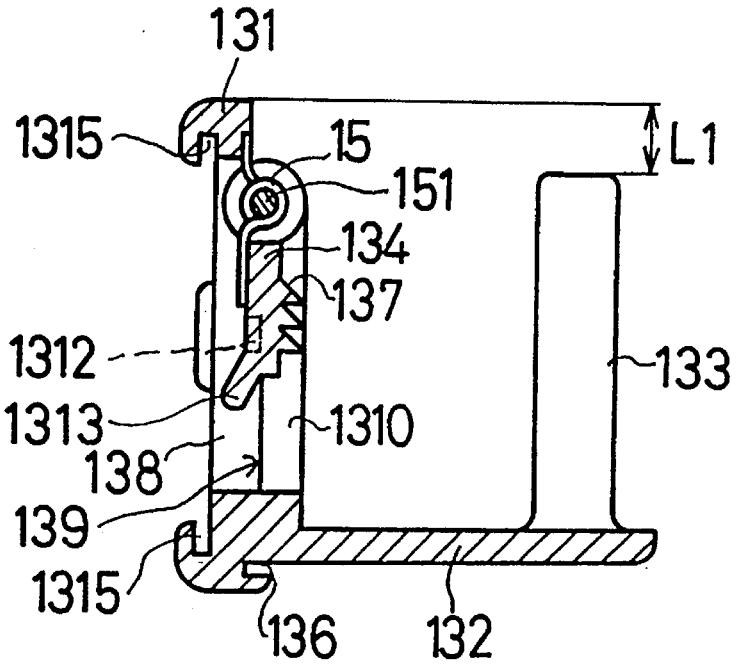
FIG. 3 shows a side sectional view of the base frame of FIG. 1
Figure 4:
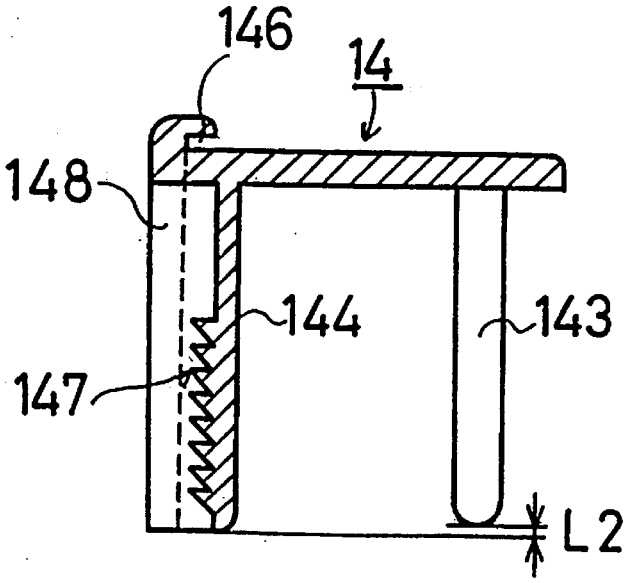
FIG. 4 shows a side sectional view of the paper holding plate of FIG. 1
Figure 6:
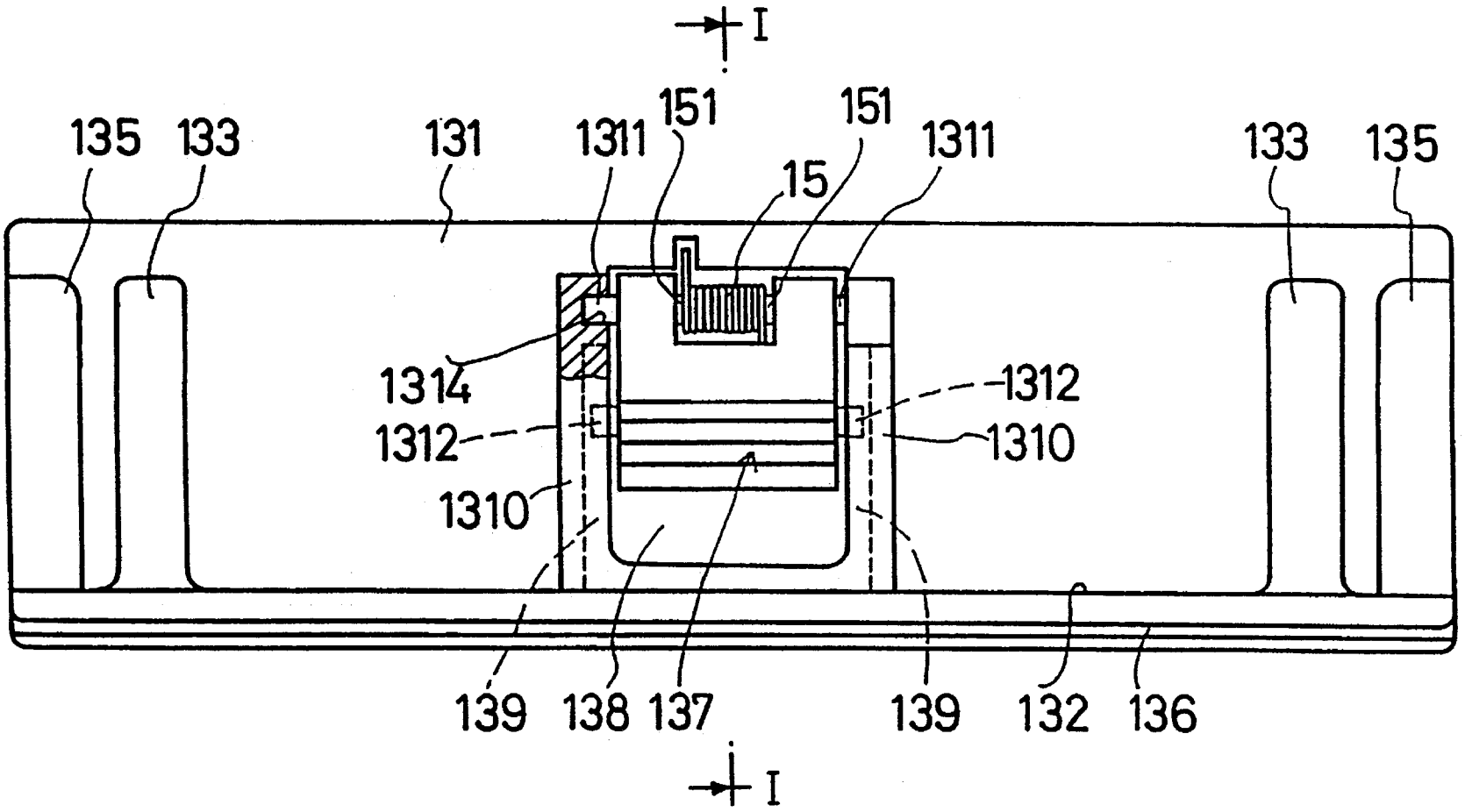
FIG. 6 shows a front view of the paper holding plate

FIG. 8 is a laterally sectional view of along A—A line of FIG. 1, wherein the side edges 145 of the paper holding plate 141 are inserted slidably in the guide portion 135 of the base frame 13, a guide surface 148 (see FIG. 4) formed on the rack portion 144 is guided slidably on a wall face 1310 of the base frame 13, whereby the paper holding plate 141 can move up and down along the base frame 13. Referring to FIG. 3 and FIG. 6 which shows a right side of FIG. 3, stopper 1312 are provided on both sides of the click member 134 which abuts against a step 139 to prevent a further rotation of the click member 134 while being biased resiliently by the spring 15.

Figure 2:
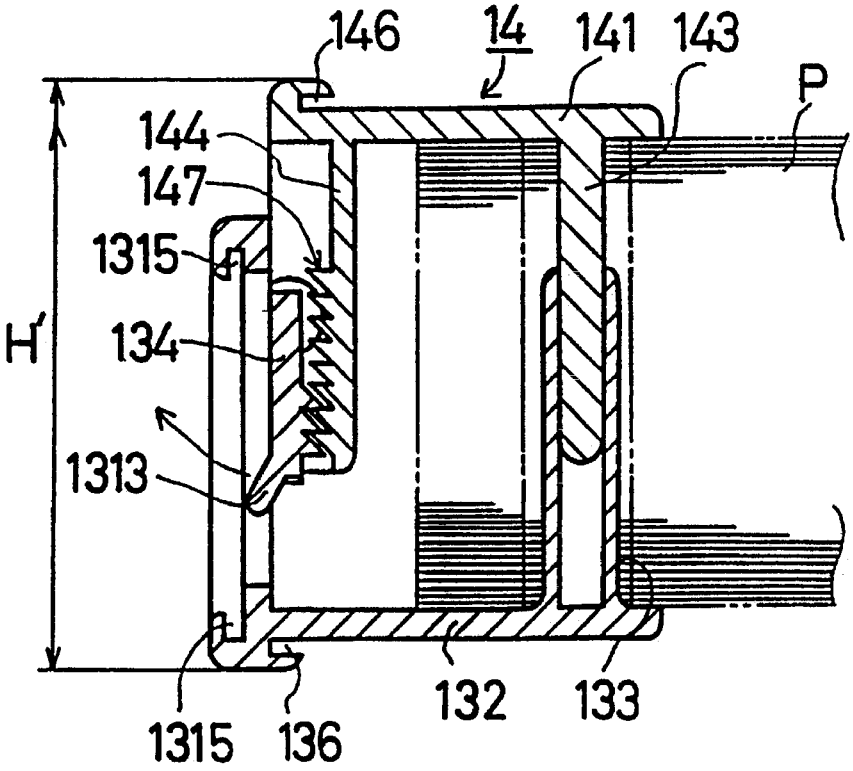
FIG. 2 shows a side sectional view of the paper holding plate in lifted position from FIG. 1

Further, on the lowermost end of the click member 134, a knob 1313 is provided, and by turning the knob with fingers in an arrow direction as shown in FIG. 2 against the resilient force of the spring 15, the engagement of the click pawl 137 with the rack teeth 147 is released, thereby the paper holding plate 141 can move upward. And when the paper holding plate 141 is depressed, the engagement of the click pawl 137 and the rack teeth 147 does not occur because in such downward movement of the paper holding plate, the back sides of the saw teeth of the click pawl 137 and the rack teeth 147 contact slidably even if the click pawl 137 is biased against the rack teeth resiliently, accordingly the rotational operation of the knob 1313 is not necessary and just depressing of the paper holding plate 141 is sufficient.

FIG. 3 shows the base frame 13 of FIG. 1, and also shown in FIGS. 5 and FIG. 6 which is a front view of FIG. 5, a square opening 138 is provided on the rear plate 131 for accommodating the click member 134 and in the wall of the opening 138 pivoting holes 1314 are provided to receive pivots 1311 of the click member 134.

Figure 7:
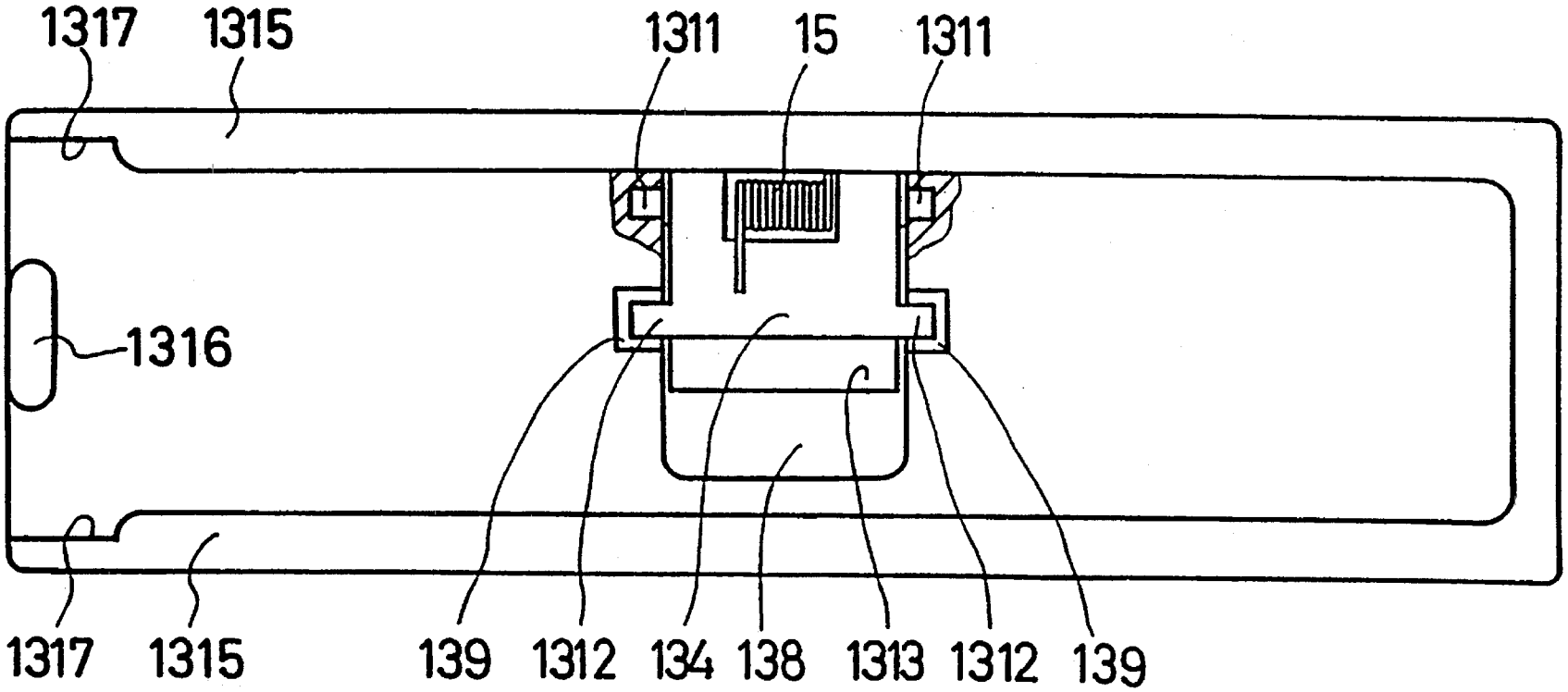
FIG. 7 shows a rear view of the paper holding plate

And on the outer side of the rear plate 131, as shown in FIG. 3, a groove 1315 for a back head is provided and as shown in FIG. 7 which shows the backside of FIG. 3, the upper end of the groove is opened for receiving the back head.

As shown in FIG. 3, the height of the paper binding cylinder 133 is smaller than the width size of the rear plate 131 by the size of L1, on the other hand, the height of the paper binding pins 143 is smaller than the width size of the rack portion 144 (the rack forming plate 142) by the size of L2.

Next, the operation of the embodiment of thus constructed is explained hereinafter. The steps to be followed are as follows, as shown in FIG. 3, to remove the paper holding plate 141 from the base frame 13, then to overlap the papers to be bound on the paper binding cylinders 133 by inserting the cylinders 133 through the holes punched on the papers, and to insert the binding pins 143 into the paper binding cylinders 133 while inserting the side edges of the rack forming plate 142 into the guide portions 135.

Then, upon depressing the paper holding plate 141, in accordance with the thickness of the piled papers, the click pawl 137 engages with the rack teeth 147 either at the position where the paper holding plate 142 abuts against the top end of the cylinder 133 or at the position of where thickness size of the papers exceeds the height of the cylinder 133, as a result, the paper supporting plate and the paper holding plate clamp the papers.

On the other hand, since the base frame 13 is formed in L-letter shape in section with the paper supporting plate 132 and the rear plate 131, and the paper holding plate 141 is connected to the rack forming plate 142 in L-shape in section, the rigidity due to the unification of the paper supporting plate 132 and the paper holding plate 141 through the insert of the rack forming plate 142 into the guide portions 135 contributes to secure the paper clamping force, at the area close to the top end of the binding cylinder 133, due to the tip ends of the paper supporting plate 132 and the paper holding plate 141, and thereby it becomes possible to maintain the above rigidity due to such unification as made by the engagement of the click pawl 137 with the rack teeth 147 of the rack forming plate 142.

Thus, since the papers are clamped under the rigidity due to the unification of the paper supporting plate 132 and the paper holding plate 141 in the area of the top end of the paper cylinder being located at the ends of such plates, the space arranging the click member to be explained hereinafter can be secured between the rear plate 131 and the rack forming plate 142. Further, by such rigidity as maintained, even if the thickness size of the papers P piled on the cylinder 133 as shown in FIG. 2 becomes larger than the height size of the cylinder 133, by depressing such papers under the paper holding plate 141 it becomes possible to make the thickness of the papers to be piled as lower as possible. And it becomes possible to regulate the spacing between the paper supporting plate 132 and the paper holding plate 141, which enables the binder to bind papers according to the thickness thereof.

And, due to the provision of the click member 134 having the click pawl 137 rotatably on the rear plate 131 of the base frame 131, which engages with the rack teeth 147 provided on the rack forming plate 142, when depressing the paper holding plate 141 along the rear plate 131, since the backs of the click pawl 137 and the rack teeth 17 contacts slidably without engagement while the click member 134 escaping resiliently, the paper holding plate goes down smoothly, thereby the click pawl 137 and the rack teeth 147 are engaged each other at position where the papers are depressed in a lowermost and compacted manner and the rack forming plate 141 is prevented from being moved upward, which enables the paper holding plate 141 to bind the piled papers having thickness size of more than the height size of the paper binding cylinder 133 as thin as possible.

Further, on the areas of both side edges of the rear plate 131 of the base frame, the guide portions 135 are provided and therein both sides 145 of the rack forming plate 142 are inserted slidably, thereby an unification of the rear plate and the rack forming plate 142 is realized in such a manner as the rear plate 131 and the rack forming plate 142 are prevented from departing each other in opposite direction but allowed to move vertically along the rear plate 131.

And due to such unification preventing the rear plate 131 and the rack forming plate 142 from departing each other in opposite direction, the engagement of the rack teeth provided on the rack forming plate 142 and the click pawl 137 of the click member 134 mounted rotatably on the rear plate 131 is secured, thereby it becomes possible to bind the papers having a given piled thickness size more than the height size of the paper binding cylinder 133 while preventing the rack forming plate 142 from moving upward to spread the space between the and the paper holding plate 141.

The above explanation is made in the case the thickness size of the piled papers is greater than the height size of the paper binding cylinder 133, but if it is the case such thickness size is smaller than the height size of the cylinder 133, the spacing between the paper supporting plate 132 and the paper holding plate 141 corresponds to the size of the height of the paper binding cylinder 133. That means, when the thickness size of the papers to be bound is within the height size of the paper binding cylinder 133, the thickness of the binder becomes H as shown in FIG. 1 i.e. the minimum thickness, further, when the thickness size of the papers to be bound is greater than the height size of the paper binding cylinder 133, as explained previously, the thickness size of the binder is determined as H' indicated in FIG. 2 according to the papers thickness which is obtained by depressing the paper holding plate 141 to compact the papers P, and such thickness is secured by the engagement of the click pawl 137 and the rack teeth 147. Thereby, a given thickness of papers P piled can be held firmly.

When opening the binder in which the papers P are bound in a compacted manner, although it is difficult to open to see the papers clamped between the paper supporting plate 132 and the paper holding plate 142, by once disengaging the click pawl 137 from the rack teeth 147, moving the paper holding plate upward and again engaging the click pawl 137 with the rack teeth 147 at a given position, the compacted portion of the papers is loosened and allowed to see each paper easily or write anything thereon.

And, since the click member 134 is installed with the spring 15 for biasing it resiliently in an inside direction of the rear plate 131 and mounted on the rear plate 131 rotatably, when depressing the paper holding plate 141 along the rear plate while being guided in the guide portions, the engagement of the click pawl 137 and the rack teeth 147 of the rack forming plate 142 is automatically carried out. Thereby, it becomes possible to bind a piled papers having a given thickness size easily by simple depressing operation of the paper holding plate 141 in a compacting manner.

Further, since the height size of the paper binding cylinder 133 and the paper binding pin 143 is smaller than the vertical size of the rear plate 131 and the rack portion 144, when inserting the side edges 145 into the guide portion 135, the cylinder 133 and the pin 143 are still spaced with each other, which enables the side edges 145 to be inserted easily into the guide portion 135. On the contrary, if such sizes are greater, all positions between the paper binding cylinders and the paper binding pins 143 are to be arranged in such a manner as precise coincidence of the connecting position is realized, which brings about the difficulty against easy assembly of the base frame 13 and the paper holding member 14.

Therefore, if the height size of the paper binding cylinder 133 and the paper binding pin 143 is smaller as previously mentioned, merely by inserting the side edges 145 into the guide portions 135 the inserting position of the paper binding pin 143 into the paper binding cylinder 133 is automatically adjusted.

Figure 9:
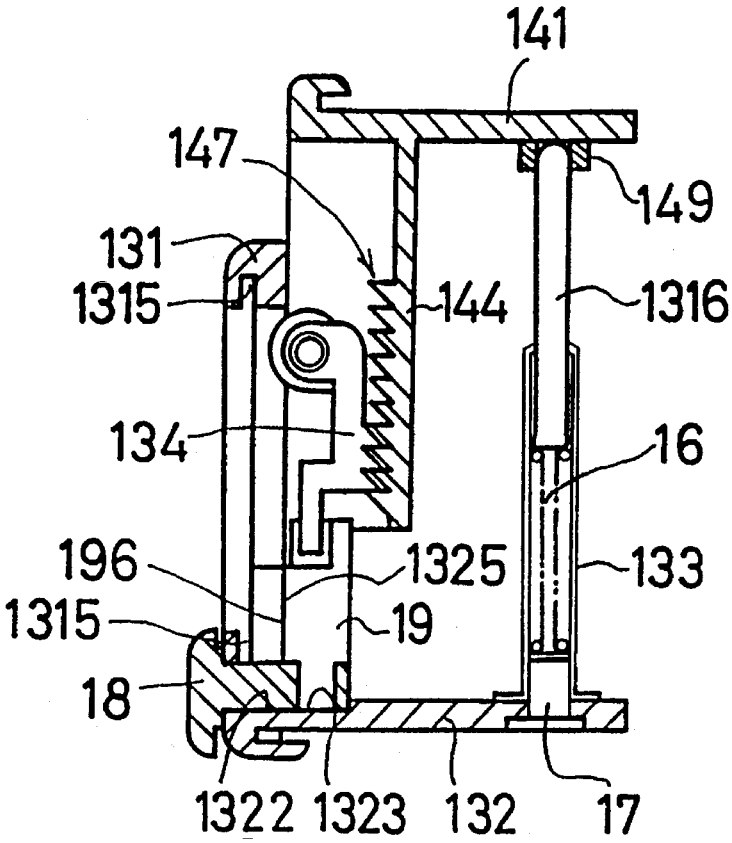
FIG. 9 shows a side view of the another embodiment of the present invention wherein a movable pin is elongated from paper binding cylinder
Figure 10:
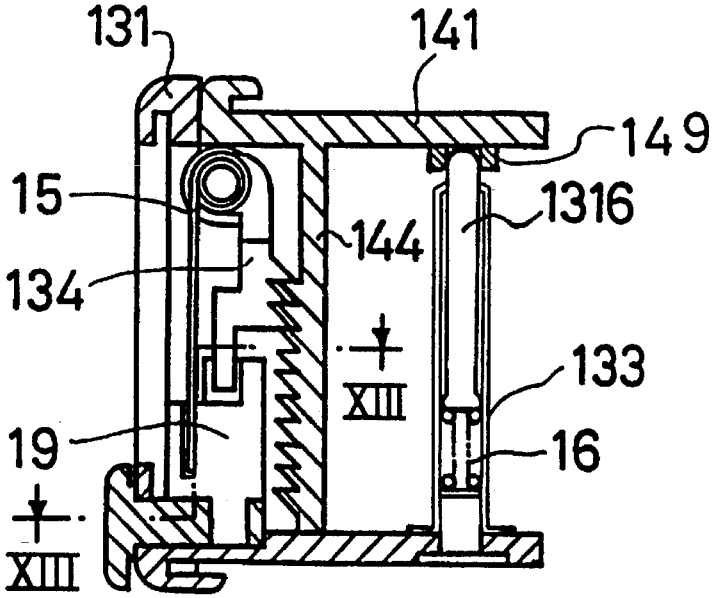
FIG. 10 shows a side sectional view of FIG. 9 in the state of the paper holding plate in depressed position
Figure 21:
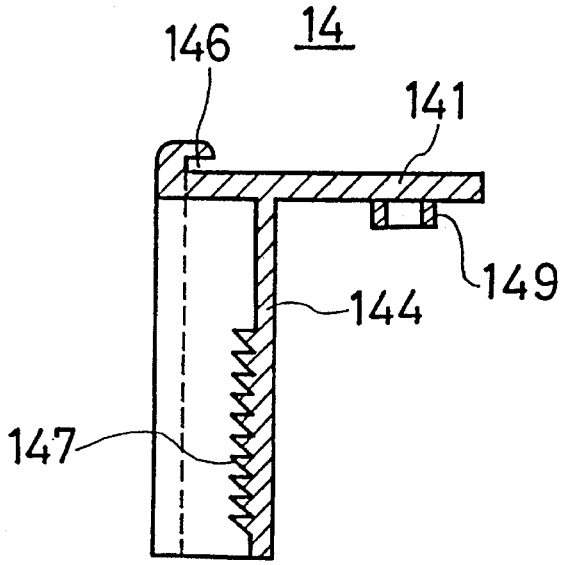
FIG. 21 shows a side sectional view of the paper holding plate of FIG. 9

Next, other embodiments are explained. Referring to an embodiment of FIG. 9, a movable pin 1316 is inserted slidably in a paper binding cylinder 133 via a contraction spring 16, which is fixed on the paper supporting plate 132 by a nut 17, wherein the movable pin 1316 is projected resiliently from the paper binding cylinder 133. The corresponding paper holding plate 141 is as shown in FIG. 21, provided with a recess 149 in which the head of the movable pin 1316 is received for holding the pin. By this holding structure, as shown in FIGS. 9 and 10, the whole of the cylinder and the pin becomes stable in the light of rigidity.

Figure 22:
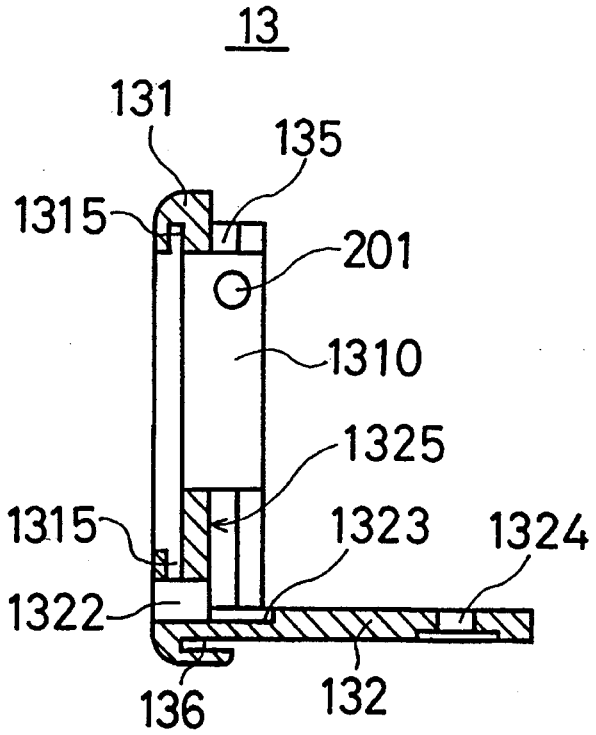
FIG. 22 shows a side sectional view of the base frame of FIG. 9

The reference numeral 1324 of FIG. 22 is a hole for fixing the paper binding cylinder 133.

Figure 11:
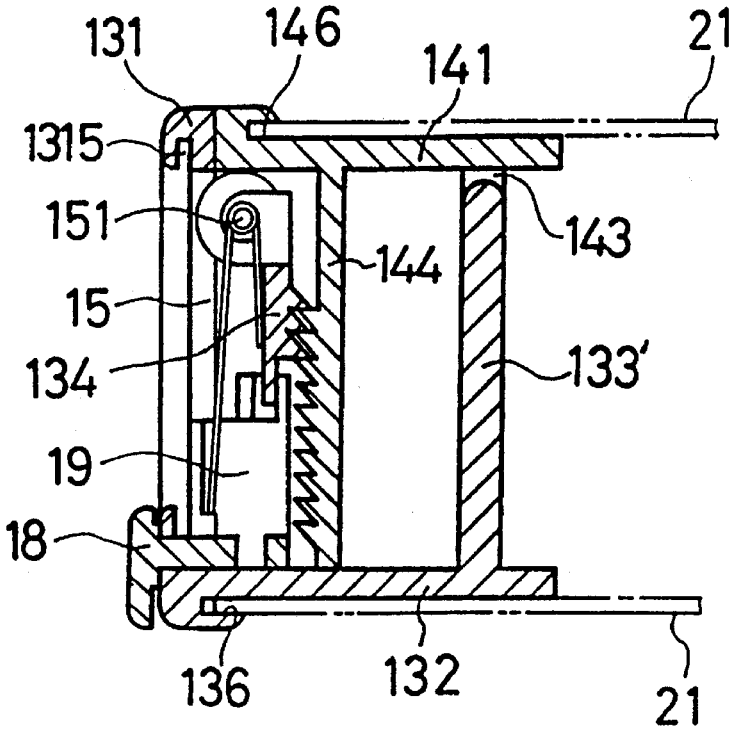
FIG. 11 shows a vertical side view in section of the fourth embodiment of the present invention wherein paper binding pins are planted on both the paper supporting plate and the paper holding plate in place of the combination of a paper binding cylinder and a pin to be inserted in said cylinder
Figure 12:
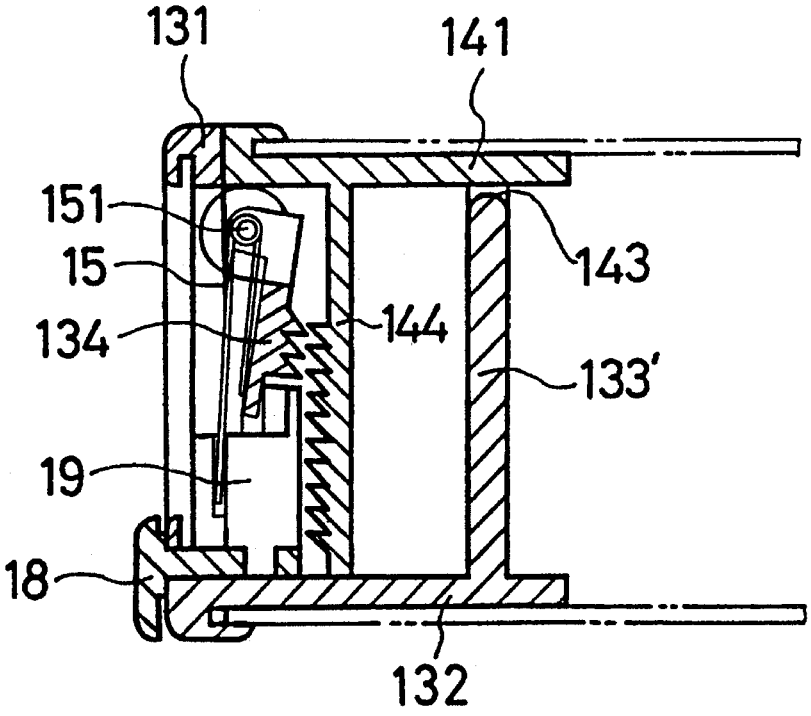
FIG. 12 shows the position of the click member after being rotated
Figure 15:
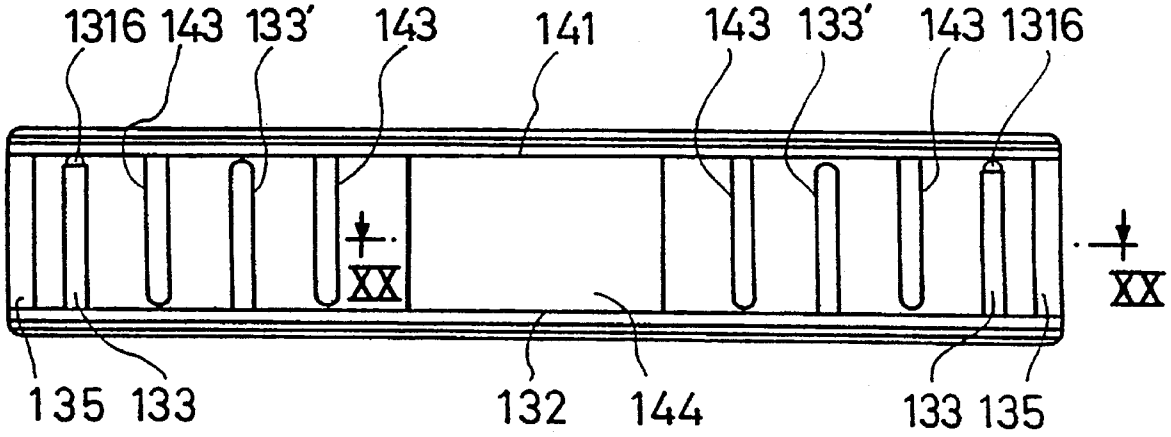
FIG. 15 shows a front view of FIG. 11
Figure 16:
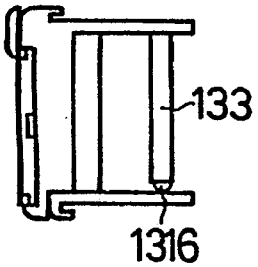
FIG. 16 shows a left side view of FIG. 15
Figure 17:
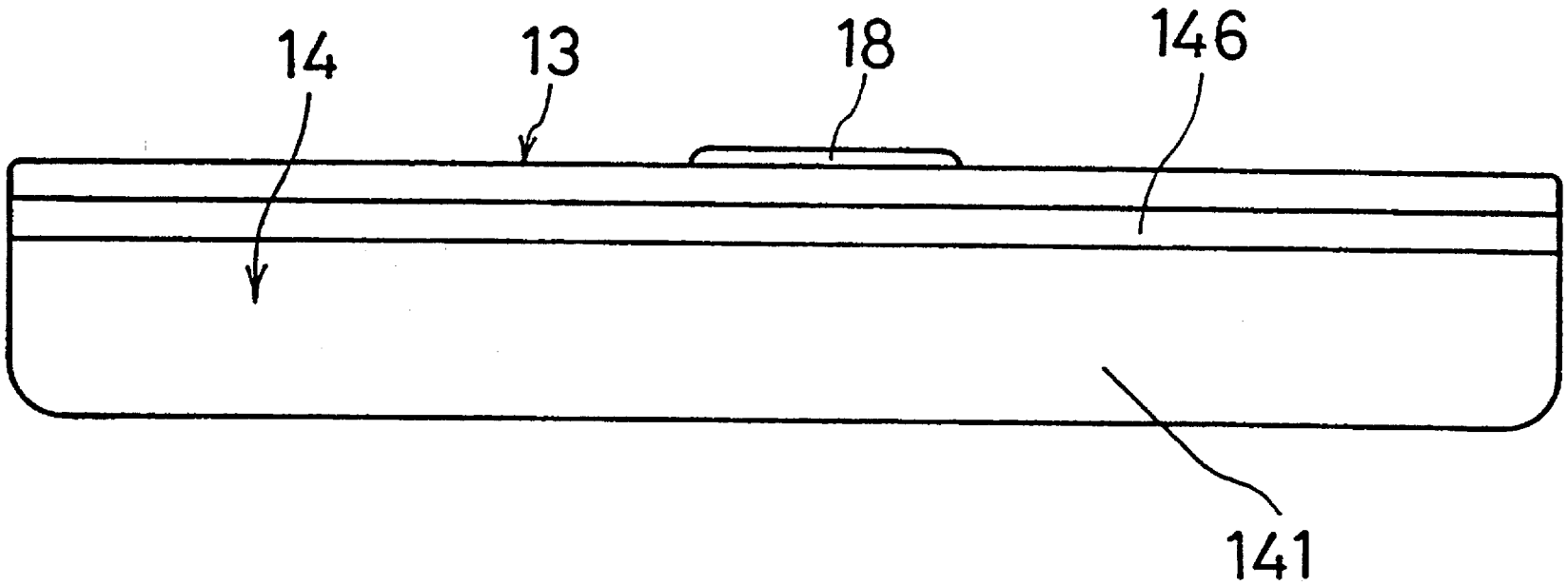
FIG. 17 shows a plan view of FIGS. 9 and 11

In FIG. 10A, a further modification of the paper binding cylinder and the pins is shown, in which a movable pin corresponding to the above movable pin 1316 is formed hollow as a movable pin 133*b* and the paper binding pin 143 is inserted into the movable pin 133*b* to hold it in place of afore-mentioned recess 149. The movable pin 133*b* has a flange 133*d* which is hooked against the tip end portion reduced in diameter of the paper binding cylinder 133 for preventing it from releasing. And in such a position as the movable pin 133*b* is projected outermost, the engagement of the click pawl 147 and the rack teeth 147 is adapted to disengage. Further, in such a position, the length of the paper binding pin 143 is adapted to elongate passing over the flange 133*d* into the inside of the cylinder 133. In a further modification of the embodiment of the present invention illustrated in FIG. 11, there is no paper binding cylinder and in place of such a combination as a cylinder is inserted by a paper binding pin, paper binding pins 133' and the paper binding pins 143 are planted on the paper supporting plate 132 and the paper holding plate 141 respectively and alternately, the locations thereof are adapted to, as shown in FIG. 15, coincide with the punched holes of the papers to be bound. In FIGS. 15 and 16, on both side of the paper supporting plate 132 two paper binding cylinders 133 other than the paper binding pins 133' are shown with movable pins 1316 inserted therein.

Thus, since two paper binding cylinders 133 are provided on both sides of the paper supporting plate 132, when the paper holding plate 141 are removed from the base frame 13, the movable pins 1316 are projected from the cylinders and become higher than the height of the paper binding pins 133'. Accordingly, even if the thickness size of the papers to be bound becomes larger than the height size of the paper binding pin 133', the papers protruding from the pins 133' are still positioned in align with said two movable pins 1316 projecting from the cylinders 133, so that the paper binding pins 143 are easily inserted into the punched holes of the papers.

Figure 23:
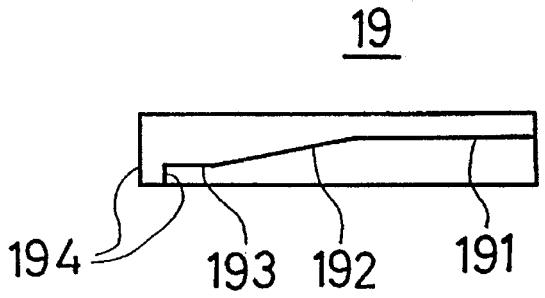
FIG. 23 shows a plan view of the slider of FIGS. 9 and 11
Figure 24:
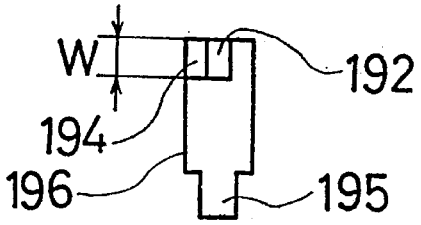
FIG. 24 shows a right side view of FIG. 23
Figure 25:
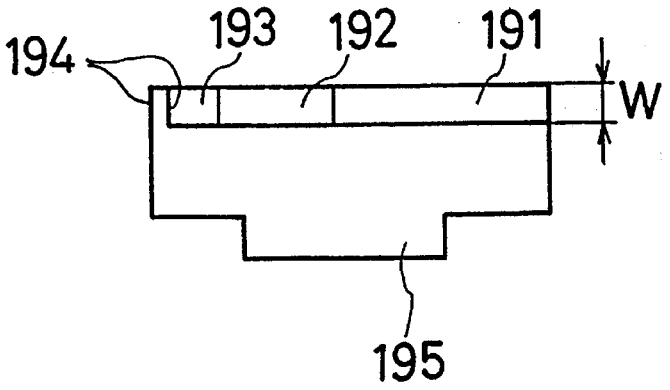
FIG. 25 shows a front view of FIG. 23

Next, a slider 19, which is actuated by a knob 18 to rotate the click member 134 to free the engagement of the click pawl 137 with the rack tooth 147, is explained. FIG. 23 is a plan view of the slider having a cam comprising an engagement surface 191, an operating surface 192 and a freeing surface 193, the width of which is designated as W in FIG. 24 showing a side view of the slider 19. In FIG. 24 numeral 196 designates a guide wall of the slider. And a numeral 194 of FIG. 25 showing the front view of the slider is a stopper located at the end of the surface 193.

Figure 26:
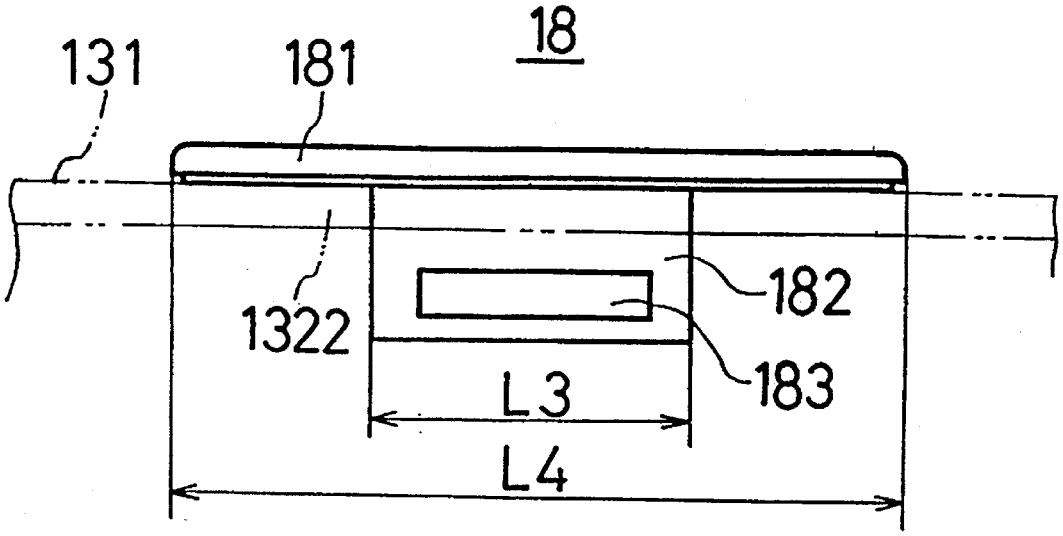
FIG. 26 shows a front view of a knob of FIGS. 9 and 11
Figure 27:
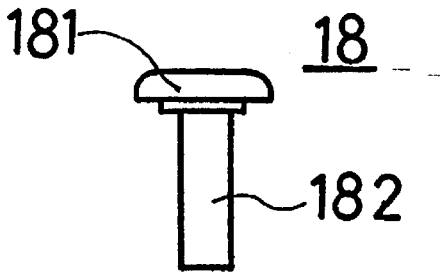
FIG. 27 shows a side view of FIG. 26

A knob 18 consists of a knob portion 181 and a guide portion 182 as shown in FIGS. 26 and 27, and the guide portion 182 is provided with a joint opening 183 in which a joint 195 of the slider 19 is jointed. And the length L4 of the knob portion 181 is set so long compared with the length L3 of the guide portion 182, that the displacement of the knob portion 181 in a guide opening 1322 (see FIG. 13) provided on the rear plate 131 does not reveal said opening 1322.

Figure 31:
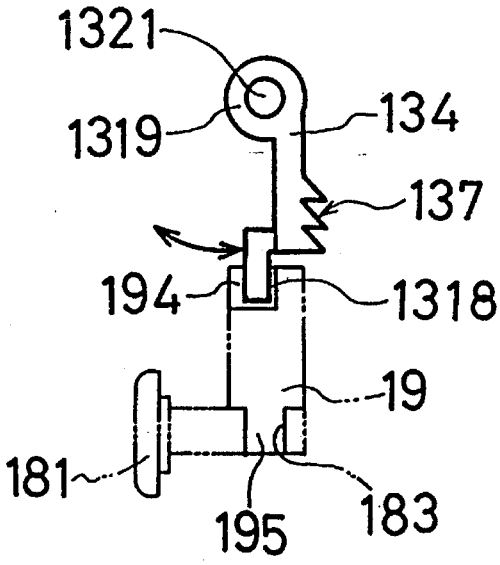
FIG. 31 shows a right side view of FIG. 30
Figure 32:
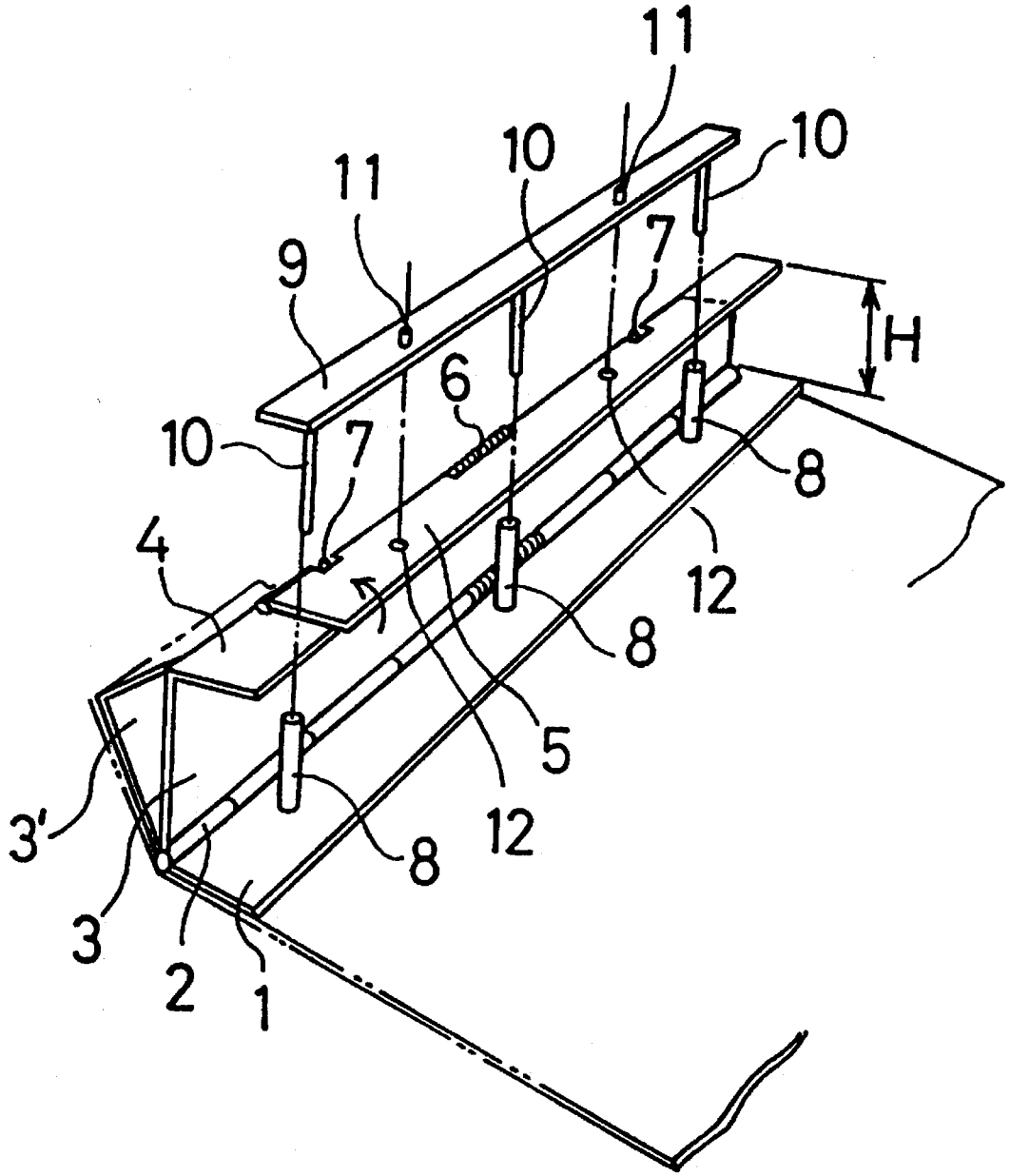
FIG. 32 shows a disassembled perspective view of a conventional binder

Further, FIG. 22 also shows in section that the guide opening 1322 for guiding the guide portion 182 and a guide recess 1323 are provided on the rear plate 131. As shown in FIG. 31, the joint 195 of the slider 19 is jointed with the joint opening 183 of the guide portion 182 of the knob 18. The guide portion 182 of the knob 18 is guided on the guide opening 1322 and the guide recess 1323 as shown in FIG. 9. And the guide surface 196 of the slider 19 is guided by sliding on the guide face 1325 of the rear plate 131.

According to the above structure, the slider 19 is smoothly displaced by the knob 18.

Figure 28:
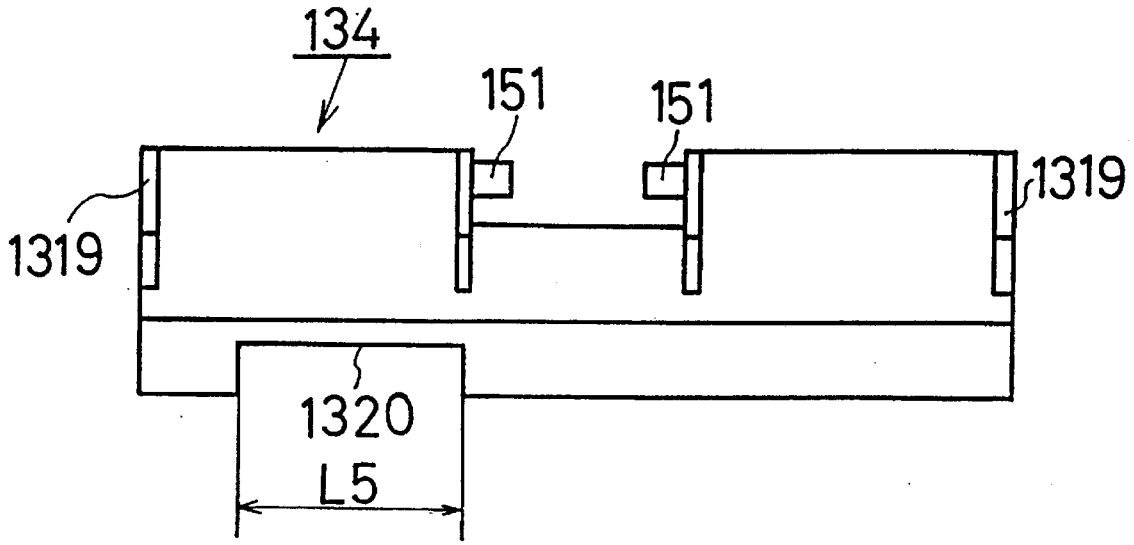
FIG. 28 shows a front view of the click member of FIGS. 9 and 11
Figure 29:
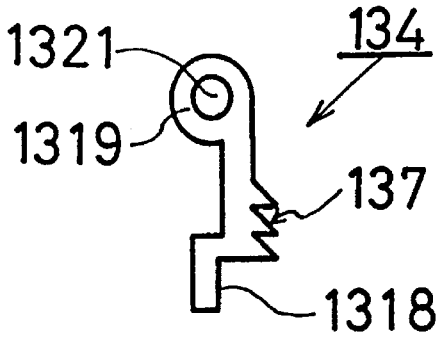
FIG. 29 shows a right side view of FIG. 28

The click member 134 comprises a slider contact face 1318 provided under the click pawl 137 as shown in FIGS. 28 and 29, and on this face 1318 a joint opening for the slider joint portion 1320 is provided.

Figure 14:
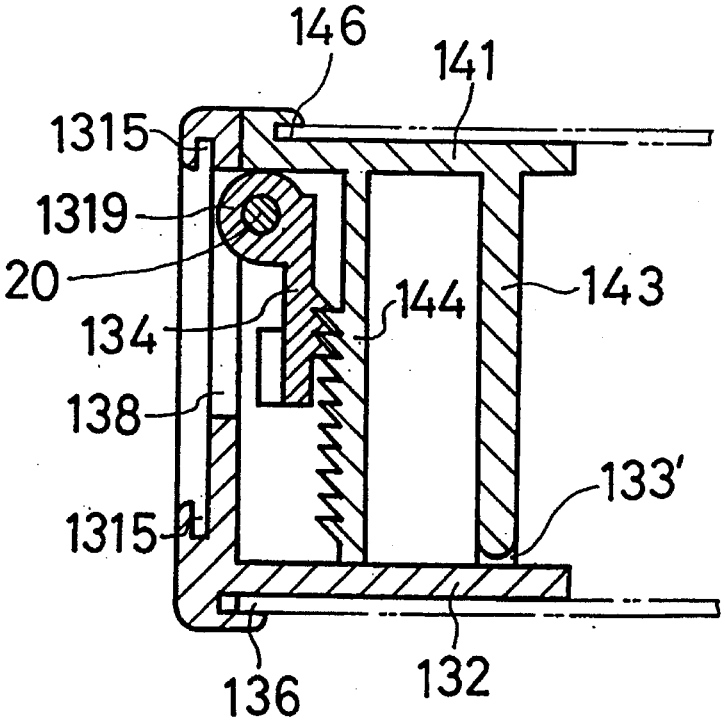
FIG. 14 shows a sectional view along E—E line of FIG. 18
Figure 18:
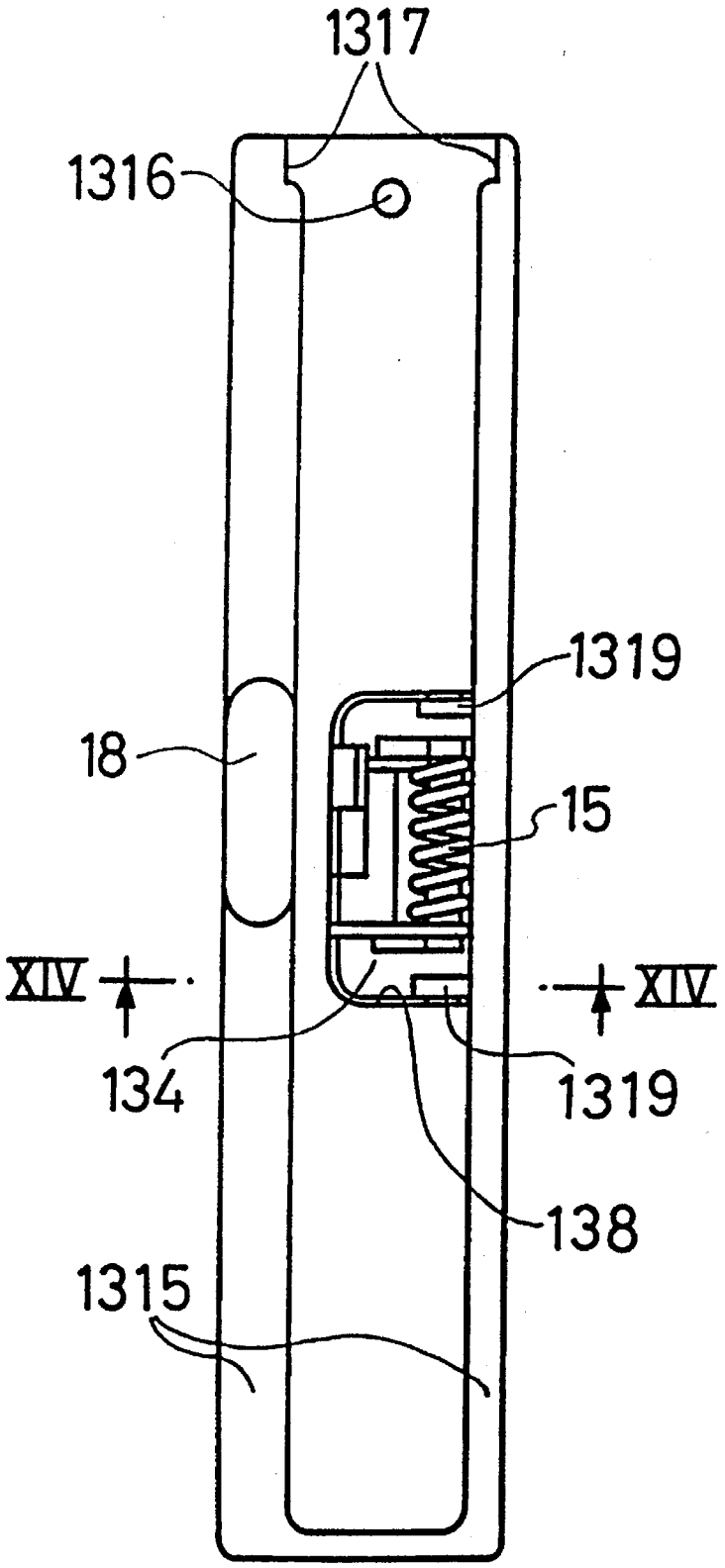
FIG. 18 shows a rear view of FIGS. 9 and 11
Figure 19:
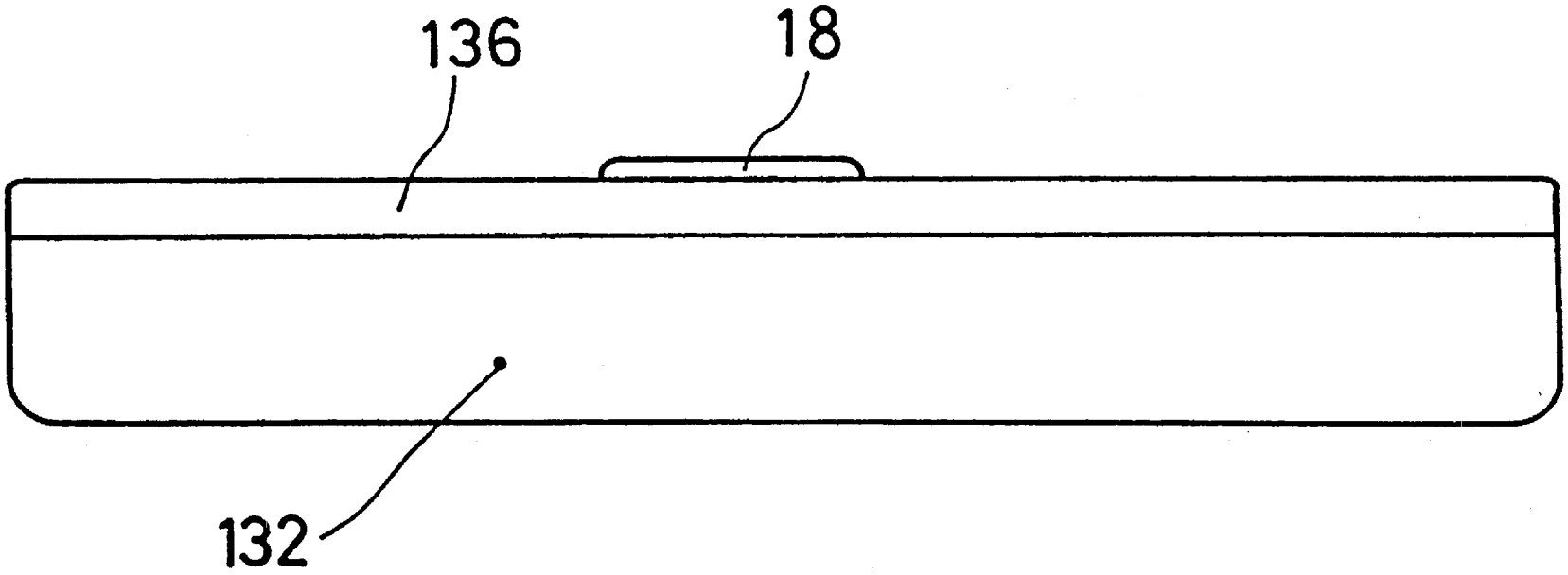
FIG. 19 shows a bottom view of FIGS. 9 and 11
Figure 30:
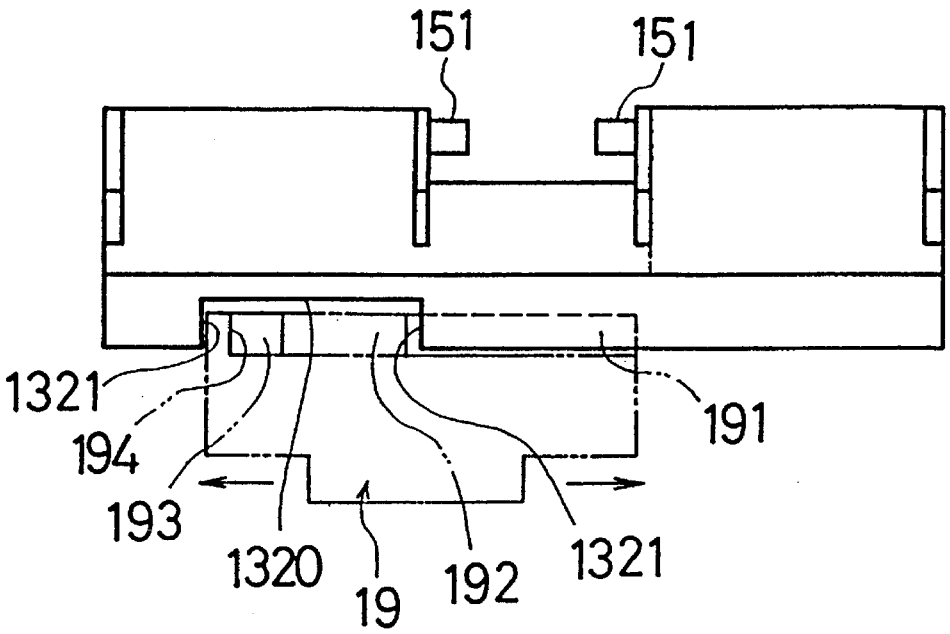
FIG. 30 shows a front view showing the relation between a click member and a slider

The numeral 1319 designates a mounting portion for mounting the click member 134 rotatably on the rear plate 131 having a pivot hole 1321. As shown in FIG. 14 of a vertically sectional view along E-E line of FIG. 18, a shaft 20 goes through the pivot hole 1321 and the pivot hole 201 of FIG. 22, thereby the click member 134 is mounted on the rear plate 131 rotatably. The numeral 151 designates a spring receiver for installing the same. FIGS. 30 and 31 explain the relationship between the click member 134 and the slider 19, in which the stopper 194 of the slider 19 is joined in the slider joint portion 1320 so as to be displaced within the space L5 of the joint portion 1320 (see FIG. 28).

Figure 13:
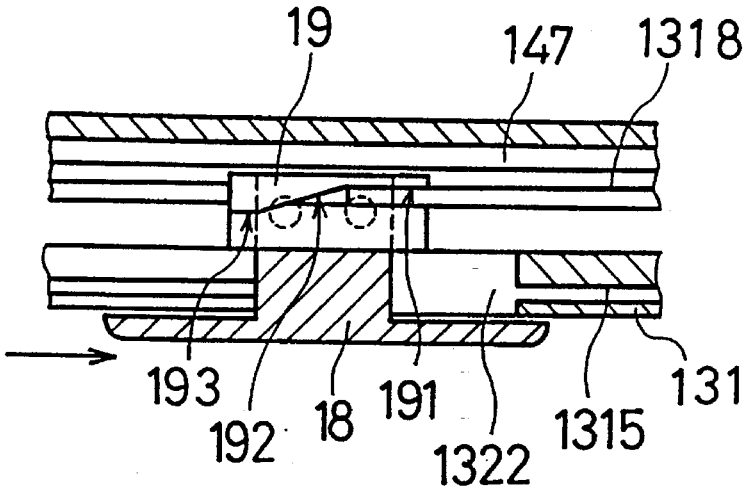
FIG. 13 shows a sectional view along D—D line of FIG. 10

And as illustrated in FIG. 13 of a laterally sectional view along D—D line of FIG. 10, either one of the engagement surface 191, the operating surface 192 and the freeing surface 193 of the slider 19 is adapted to contact to the slider contact face 1318 of the click member 134.

Accordingly, when displacing the slider 19 through the knob 18, while the slider contact face 1318 of the click member 134 slides on the engagement surface 191, the click member 134 does not rotate, and when the contact face 1318 begins to slide on the operation surface 192, the click member 134 starts to rotate in the pivot hole 1321 provided on the mounting portion 1319 and as long as the slider contact surface 1318 stays on the freeing surface 193, the click member 134 is kept disengaged with the rack teeth. And by the displacement of the slider 19 into the reverse side, the click member 134 is allowed to return to the initial position of the engagement surface 191 by the resiliently biasing force of the spring 15 installed in the spring receiver 151 through the operation surface 192 and the engagement surface 191.

Figure 20:
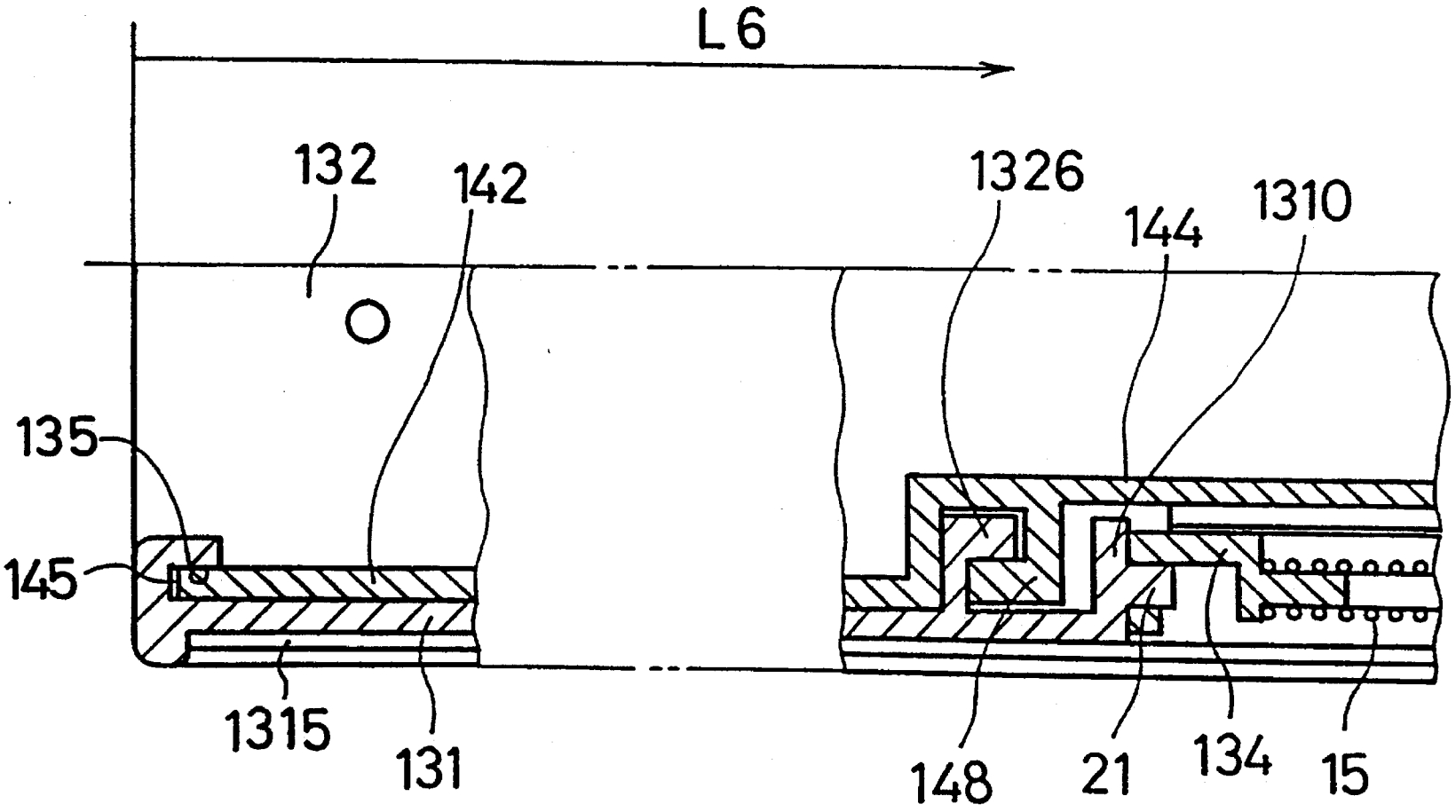
FIG. 20 shows a partial enlarged side view of in section along F—F line of FIG. 15

In FIG. 20 of the sectional view along F-F line of FIG. 15, it is shown that the side edges 145 of the rack forming plate 142 are inserted into the guide portions 135 provided on the side area of rear plate 131, and inside the rack portion 144 a guide angle portion 148 which engages with a counter guide angle 1326 provided on the rear plate 131, thereby the rack forming plate 142 is prevented from departing from the rear plate 131 in an opposite direction with each other but allowed to move in the vertical direction.

The function of the present invention thus constituted is explained as follows. Prior to binding papers, the paper holding member 14 is removed from the base frame 13. In this connection as shown in FIG. 9, a movable pin 1316 is inserted into the paper binding cylinder 133 through a contraction spring 16, so that by removing the paper holding plate 141 the movable pin is projected from the cylinder 133 to a topmost position, thereby even if the thickness size of the piled papers is larger than the height size of the paper binding cylinder 133, the papers are not dispersed. and it is a matter of course that such paper binding cylinder 133 can be provided on the paper holding plate 141 to play the same function.

And, since the base frame 13 is formed in L-letter shape in section with the rear plate 141 and the paper supporting plate 132, on the other hand the paper holding member 14 is formed in L-letter shape in section with the rack forming plate 142 and the paper holding plate 141, and in addition, since the rack forming plate 142 is connected and unified to the inside of the rear plate 131, even if the papers are clamped with comparatively distal end portions of the paper supporting plate 132 and the paper holding plate 141, the paper clamping strength is secured.

Thus, since the paper supporting plate 132 and the paper holding plate 141 having the rigidity due to the above unification can clamp the papers approximately near at the area where the top of the paper binding cylinder 133 is located, it becomes possible to secure a space in which a click mechanism is arranged between the rear plate 131 and the rack forming plate 142. Further, since thus the above clamping rigidity is kept, if the papers to be bound is greater in thickness size than the height size of the paper binding cylinder 133, it is possible to make the thickness of the papers as thin as possible by compacting the papers with the paper holding plate 141 while depressing the movable pin 1316. In addition, it becomes possible to bind papers while regulating the thickness size of the papers in accordance with the amount of the papers to be bound.

Further, since, on one hand, the rack forming plate 132 is provided with the rack teeth formed like upwardly directional saw teeth on its outer surface and, on the other hand, the rear plate 131 is provided with on its inner side rotatably a click member 134 having a click pawl 137 to engage with said rack teeth, upon depressing the paper holding plate 141, the click pawl 137 does not engage with the rack teeth due to the contact on the back of the rack teeth, which allows the rack forming plate to go down slidably. Upon stopping compacting the papers by the paper holding plate 141, the rack forming plate 142 is raised a little bit due to the reaction of the papers compacted, which causes the click paw 137 to engage with the rack teeth 147 to prevent the rack forming plate 142 from moving upward to keep the paper clamping. In addition, the movable pin 1316 is resiliently in contact with the paper holding plate 141 due to the contraction spring 16 and the paper holding plate 141 is engaged with the base frame 13 due to the click member 134, so that a given amount of papers can be bound as thin as possible while preventing the space between the paper supporting plate 132 and the paper holding plate 141 from spreading.

Further, guide portions 135 are provided on the area near the each side edge of the rear plate 131, into which both side edges 145 of the rack forming plate 142 are guided and at the middle portion of the rear plate 131 and the rack forming plate 142 a guide angle 148 and a counter guide angle 1326 are provided respectively and coupled with each other in such a manner as allowing the rack forming plate 142 to move vertically against the rear plate 131 but preventing it from moving in an opposite direction, so that even if the width of L6 of FIG. 20 is long the unification becomes possible.

Thus, due to the unification of the rack forming plate 142 and the rear plate 131 without departing in an opposite direction each other, the afore-mentioned rigidity between the paper supporting plate 132 formed in L-letter shape with the rear plate 131 and the paper holding plate 141 formed in L-letter shape with the rack forming plate 142 is secured. And due to such unification, the engagement of the the click pawl 137 with the rack teeth 147 provided on the rack forming plate 142 is secured, and it becomes possible to bind a given amount of papers even if such amount is large while preventing the space between the paper supporting plate 132 and the paper holding plate 141 from being spread.

The above explanation is about a case in which the thickness size of papers to be bound is larger than the height size of the paper binding cylinder, but in case the former size is smaller than the latter size, by depressing the paper holding plate 141, the space between the paper supporting plate 132 and the paper holding plate 141 coincides to the height size of the paper binding cylinder 133. That is, when the amount of papers to be bound is small and the thickness size is within the height of the paper binding cylinder 133, the total thickness of the binder is constant, on the contrary, when the number of sheets of papers is increased and the thickness size becomes larger than the height size of the paper binding, by depressing and compacting, as shown in FIG. 9, the paper holding plate 141, the paper holding plate 141 is fixed to the rear plate 131 by the engagement of the the click pawl 137 and the rack teeth 147 of the rack forming plate 142 at the position according to the amount of the papers to hold the papers firmly.

Further, since the click member 134 is mounted on the rear plate with a spring 15 installed which continues to give a resiliently a biasing force to said member forwarding to the inner side of the rear plate, by depressing the paper holding plate 141 along the rear plate 131 toward the paper supporting plate 132 the engagement of the click pawl 137 of the click member 134 and the rack teeth 147 of the rack forming plate 142 is done automatically, which enables the binder to bind papers merely by depressing the paper holding plate 141.

And, in the present invention, the click member 134 is provided with a slider guide surface 1318 on a lowermost end of the click member 134 as shown in FIG. 29, on the other hand, the slider 19 having an operating surface 192, which slides on said slider guide surface 1318, is mounted on the rear plate 131 as shown in FIG. 23. Wherewith, a knob 18 is attached to the slider 19 which is projected on the outside of the rear plate 131 and by operating the knob 18 the usual engagement of the click pawl 137 and the rack teeth 147 is released, thereby the paper holding plate can be removed from the base frame 13 for binding easily some additional papers.

Further, on the outside of the paper supporting plate 132 and the paper holding plate 141, headcover grooves 136 and 146 are provided, thereby it is possible to cover the papers bound and such cover is easily replaced by another one desired. And since the headcover 21 (see FIG. 11), the paper holding plate 141 and the base frame 13 can be disassembled, at the time of storing or carrying those binders to market etc. it does not occupy space too much and can save the storing space and carrying cost.

As mentioned above, the binder of the present invention is constituted by the base frame formed in L-letter shape in section with the paper supporting plate and the rear plate, and the paper holding member formed in L-letter shape in section with the rack forming plate, and in addition to that the rear plate and the rack forming plate are connected, thereby the rigidity to be necessitated for clamping papers on comparatively distal ends of the paper supporting plate and the paper holding plate can be secured because of the rigidity between the rear plate and the paper supporting plate, and the paper holding plate and the rack forming plate respectively. And the above connection of the rear plate and the rack forming plate can reinforce the above rigidity further.

Due to the rigidity between the paper supporting plate and the paper holding plate for clamping the papers on the distal ends thereof, there is secured a space between the rear plate and the rack forming plate in which the click member is provided. Thus, because the above rigidity can be maintained, the papers to be bound by the paper holding plate and the paper supporting plate can be compacted and the thickness size of the papers can be made as thin as possible to minimize a storing space in a shelf. Further, due to the sliding engagement between the rear plate and the rack forming plate, the space between the paper supporting plate and the paper holding plate can be settled appropriately, which enables the binder to bind papers in accordance with the amount thereof, whereby, if the thickness of the papers to be bound is small, the space between the paper supporting plate and the paper holding plate can be reduced to a minimum one to save the space for storing such binder.

And, it can be easily carried out to regulate the thickness size of the binder simply by depressing the paper holding plate.

And, the rack teeth are provided with on the outside of the rack forming plate and a click member having click pawl which engages with the rack teeth is mounted resiliently and rotatably on the rear plate, and when the paper holding plate is depressed downward, said click pawl slips on the back of the rack teeth without engaging with the rack teeth and at a stopped position it engages with the rack teeth and prevents the rack forming plate from moving upward. By this click pawl the papers are bound in a locked state.

Further, since the rear plate is provided with guide portions on both side areas, into which both side edges are inserted for being guided, the rear plate and the rack forming plate are allowed the rack forming plate to move vertically but prevented from moving in the opposite direction, thereby those are unified in that direction, which secure the rigidity between the paper supporting plate and the paper holding plate.

And, the rear plate and the rack forming plate are provided with a guide angle and a counter guide angle in the middle portion thereof respectively, by the engagement of which the rack forming plate is allowed to move vertically but prevented from moving in the opposite direction, and thereby the rear plate and the rack forming plate are unified at the middle portion thereof as well as in the side area, whereby papers having big size can be secured to be bound.

Also, the guide surface is provided on the lowermost end of the click member, a slider having a cam surface contacting the guide surface is provided on the rear plate and a knob is projected on the outside of the rear plate from the slider, the operation of which enables the click pawl usually engaging with the rack teeth to be disengaged from the rack teeth. Thus, the binder can bind easily additional papers.

Finally, according to the present invention, since the movable pin is inserted in the paper binding cylinder through the contraction spring biasing the pin to project from the paper cylinder which is fixed on the paper supporting plate or on the paper holding plate, even if the paper holding plate is removed from the base frame, the papers are not dispersed because the movable pin is projected in the longest position, thereby some additional papers can be easily bound.

What is claimed is:

1. A binder to bind papers between a paper supporting plate and a paper holding plate by inserting paper binding cylinders into holes within said papers, comprising:

said paper binding cylinders, a rear plate joined at about a 90° angle to an edge of said paper supporting plate, a rack forming plate joined at about a 90° angle to an edge of said paper holding plate, said rack forming plate having an external surface opposing and overlapping an internal surface of said rear plate, guide portions provided along both side edges of said internal surface of the rear plate for guiding both side edges of the rack forming plate and allowing a vertical and parallel movement of the rack forming plate against the rear plate, saw-toothed rack teeth provided on the external surface of said rack forming plate opposing the internal surface of the rear plate, a click member rotatably mounted on the rear plate, having a click pawl for selectively engaging with said rack teeth to prevent the rack forming plate from moving upward, and a spring means provided on said click member to bias said click pawl resiliently against the rack teeth.

2. A binder according to claim 1, wherein said paper binding cylinders are provided on the paper supporting plate or the paper holding plate and paper holding pins to be inserted into the paper cylinders are provided on the paper holding plate or the paper supporting plate.

3. A binder according to claim 1, wherein a movable pin is inserted into each of the paper binding cylinders through a contraction spring inserted in each of said cylinders to allow the movable pin to project resiliently from each said cylinder.

4. A binder according to claim 3, wherein said movable pin is hollow.

5. A binder according to claim 1, wherein a slider is provided on the rear plate slidably in parallel with a rotating axis of the click member at a right angle to a rotating direction of the click member, said slider being provided with a cam surface thereon which contacts a guide surface provided on a lowermost portion of the click member during sliding to cause the click member to rotate in such direction that the click pawl disengages from the rack teeth.

* * * * *